US006802455B1

(12) United States Patent
Evans

(10) Patent No.: US 6,802,455 B1
(45) Date of Patent: Oct. 12, 2004

(54) ATOMIZER

(76) Inventor: Willie V. Evans, 104 W. Lantrip, Kilgore, TX (US) 75662

( * ) Notice: Subject to any disclaimer, the term of this patent is extended or adjusted under 35 U.S.C. 154(b) by 0 days.

(21) Appl. No.: 10/400,260

(22) Filed: Mar. 26, 2003

(51) Int. Cl.[7] ..... B05B 17/00

(52) U.S. Cl. ..... 239/1; 239/89; 239/91; 239/533.9

(58) Field of Search ..... 239/1, 91, 89, 239/381, 533.9

(56) References Cited

U.S. PATENT DOCUMENTS

| | | | | | |
|---|---|---|---|---|---|
| 4,030,668 | A | * | 6/1977 | Kiwior | 239/585.4 |
| 4,057,190 | A | * | 11/1977 | Kiwior et al. | 239/558 |
| 4,295,799 | A | * | 10/1981 | Bentley | 417/240 |
| 4,711,259 | A | * | 12/1987 | Martin et al. | 134/166 R |
| 5,049,185 | A | * | 9/1991 | Andersson | 75/529 |
| 5,111,656 | A | * | 5/1992 | Simon et al. | 60/203.1 |
| 5,197,672 | A | * | 3/1993 | Grytz et al. | 239/1 |
| 5,397,581 | A | * | 3/1995 | Lerman | 426/231 |
| 5,565,241 | A | * | 10/1996 | Mathias et al. | 427/196 |
| 5,891,085 | A | * | 4/1999 | Lilley et al. | 604/68 |
| 6,263,969 | B1 | * | 7/2001 | Stoesz et al. | 166/334.4 |
| 6,578,369 | B2 | * | 6/2003 | Kunkel et al. | 62/64 |
| 6,695,168 | B2 | * | 2/2004 | Pinedjian et al. | 222/54 |

FOREIGN PATENT DOCUMENTS

| | | | |
|---|---|---|---|
| GB | 2233037 | A | * 1/1991 |
| JP | 402271252 | A | * 11/1990 |

* cited by examiner

*Primary Examiner*—William E. Tapolcai
*Assistant Examiner*—Mohammad M. Ali
(74) *Attorney, Agent, or Firm*—Patent Law & Venture Group; Gene Scott

(57) ABSTRACT

The present invention provides a simple fluid atomizer having a pair of spring loaded sealing elements such that the pressure required to open both seals is the sum of the spring constants of each of the sealing elements. A central cavity is sealed at both its entry and exit by moving elements held by coil springs. When the fluid in the entry channel is able to overcome a first spring, the first sealing element is moved so as to allow fluid to enter the central cavity. When the fluid pressure within the central cavity reaches a level necessary to compress the exit spring, the entry fluid pressure must be at a level for achieving the delta pressure across both entry and exit springs.

4 Claims, 1 Drawing Sheet

ATOMIZER

BACKGROUND OF THE INVENTION

Field of the Invention

This invention relates generally to liquid spray devices, and more particularly to an atomizer for low volume and high pressure operation.

SUMMARY OF THE INVENTION

The present invention teaches certain benefits in construction and use which give rise to the objectives described below.

The present invention provides a simple fluid atomizer having a pair of spring loaded sealing elements such that the pressure required to open both seals is the sum of the spring constants of each of the sealing elements. A central cavity is sealed at both its entry and exit by moving elements held by coil springs. When the fluid in the entry channel is able to overcome a first spring, the first sealing element is moved so as to allow fluid to enter the central cavity. When the fluid pressure within the central cavity reaches a level necessary to compress the exit spring, the entry fluid pressure must be at a level for achieving the delta pressure across both entry and exit springs.

A primary objective of the present invention is to provide a fluid atomizer having advantages not taught by the prior art.

Another objective is to provide such an atomizer capable of injecting small amounts of fluid into a high pressure line.

A further objective is to provide such an atomizer with relatively simple construction and low cost.

A still further objective is to provide such an atomizer with few moving parts and therefore high reliability.

Other features and advantages of the present invention will become apparent from the following more detailed description, taken in conjunction with the accompanying drawings, which illustrate, by way of example, the principles of the invention.

BRIEF DESCRIPTION OF THE SKETCHES

The accompanying drawings illustrate the present invention. In such drawings.

DETAILED DESCRIPTION OF THE INVENTION

Figure 1:
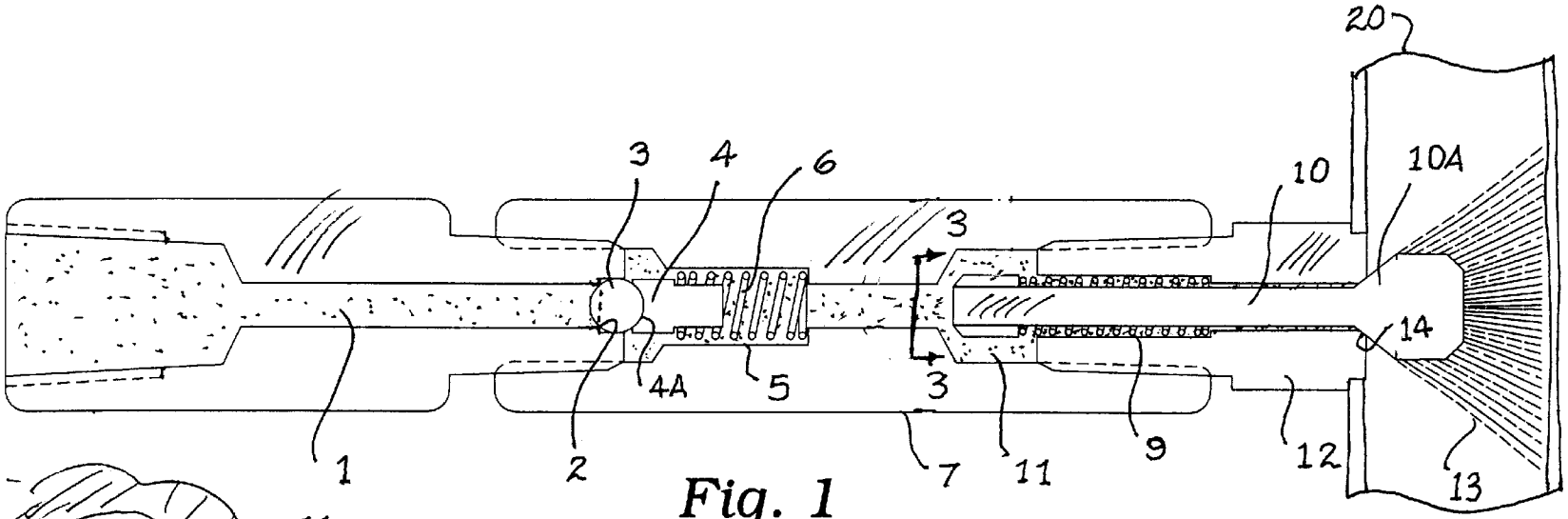
FIG. 1 is a full sectional view of a preferred embodiment of the present invention.

The above described drawing figures illustrate the invention, a high pressure, low volume atomizing liquid spray device. As shown in FIG. 1, fluid enters the device through an entry channel 1, the fluid gaining access from a source of the fluid (not shown). However, the pressure within the entry channel 1 must overcome the spring pressure of first spring 6 in order to move ball 4A away from entry channel sealing lips 2 at the terminal end of entry channel 1. It should be noticed that ball 4A is held in place by a spring end piece 4 which has a concave surface in contact with the ball 4A so as to assure that the ball 4A, when moving away from entry channel sealing lips 2, must move along the longitudinal axis of the device. Until first spring 6 is compressed, ball 4A is secured against sealing lips 2. When first spring 6 is compressed, ball 4A is moved away from the entry channel sealing lips 2 and the fluid is thus permitted to enter expansion chamber 5 where it is broken into a fine mist. The pressure within the central cavity 11 of body 7 rises to the pressure within entry channel 1 since both the entry channel 1 and the central cavity 11 are now in fluid communication. Spray nozzle center plunger 10 is forced by second spring 9 to seal against nozzle lips 14 at the terminal end of nozzle piece 12. When the fluid pressure within the central cavity 11 exceeds the spring force of second spring 9, the nozzle center plunger 10 compresses second spring 9 and thereby allows, the atomized fluid 13 to flow within the annular space about nozzle center plunger 10 to gain an exit as shown in FIG. 1. Nozzle center plunger 10 provides a conical divergent surface 10A for directing the spray in a diverging annular pattern. Because of the double spring compression requirement, in order to obtain spray at the nozzle lips 14, the pressure in the entry channel 1 must, at a minimum, be the sum of the two spring constants. Because of this, the device is able to inject small amounts of fluid into a high pressure line 20.

Figure 2:
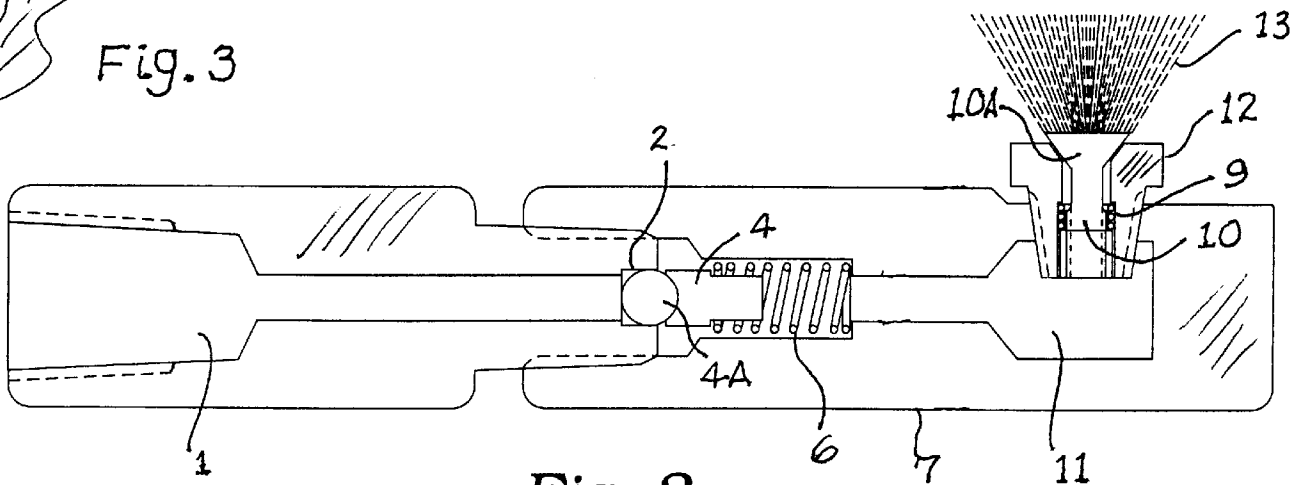
FIG. 2 is a full sectional view of an alternate embodiment of the present invention.
Figure 3:
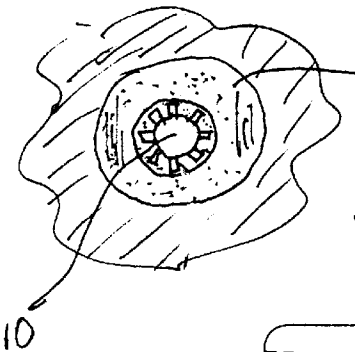
FIG. 3 is a partial sectional view taken along line 3—3 in FIG. 1.

FIG. 2 shows the invention adapted for a right angle spraying application.

The present invention may also be described in alternate terms as follows:

A mist spraying device apparatus comprises an entry channel 1 of a linear channel in a device body 7 for receiving a fluid; a terminal end of the device body 7 is positioned within a high pressure line 20. A first spring 6 is positioned for forcing a valve ball 4A against an entry sealing lips 2 in the entry channel 1 wherein a raising fluid pressure within the entry channel 1 is able to overcome the first spring 6, thereby moving the fluid through the entry sealing lips 2 into an expansion chamber 5 of the device body 7. A second spring 9 forces a central plunger 10 against a nozzle lips 14, the fluid pressure enabled for moving the central plunger 10 to direct the fluid as a mist from the nozzle lips 14, along a conical divergent surface 10A of the central plunger 10 to achieve a wide angle spray as shown; whereby a small volume of the fine mist is able to be emitted into the high pressure line 20.

The apparatus may be constructed according to FIG. 1, or alternately, FIG. 2, wherein the central plunger 10 moves linearly at 90 angular degrees relative to the movement of the valve ball 4A.

The invention provides a mist spraying method comprising the steps of: directing a fluid into an entry channel or chamber 1 of a linear channel within a device body 7, wherein a terminal end of the device body is positioned within a high pressure line 20; raising fluid pressure within the entry chamber 1 to overcome a first spring 6 so as to move a valve ball 4A away from an entry sealing lips 2 in the entry chamber 1; moving the fluid through the entry lips 2 into an expansion chamber 5; breaking the fluid into a fine mist; rising the fluid pressure in the expansion chamber 5 to compress a second spring 9, thereby unseating a nozzle plunger 10 from a nozzle lips 14 of the device body 7; directing the fine mist from the nozzle lips 14, along a conical divergent surface 10A to achieve a wide angle spray and thereby reduce the fluid pressure in the expansion chamber 5 so as to seal the nozzle lips 14; whereby a small volume of the fine mist is emitted into the high pressure line 20. The method may be used to turn the fine mist by approximately 90 angular degrees prior to emitting the fine mist into the high pressure line 20, as shown in FIG. 2.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A mist spraying device apparatus comprising: entry chamber of a linear channel in a device body for receiving a fluid; a terminal end of the device body positioned within a high pressure line; a first spring positioned for forcing a valve ball against an entry lips in the entry chamber wherein a raising fluid pressure within the entry chamber is able to overcome the first spring thereby moving the fluid through the entry lips into an expansion chamber of the device body; a second spring seating a nozzle plunger against a nozzle lips, the fluid pressure enabled for moving the nozzle plunger to direct the fluid as a mist from the nozzle lips, along a conical divergent surface of the nozzle plunger to achieve a wide angle spray; whereby a small volume of the fine mist is enabled for being emitted into the high pressure line.

2. The apparatus of claim 1 wherein the nozzle plunger moves linearly at 90 angular degrees relative to the movement of the valve ball.

3. A mist spraying method comprising the steps of: directing a fluid into an entry chamber of a linear channel in a device body, wherein a terminal end of the device body is positioned within a high pressure line; raising fluid pressure within the entry chamber to overcome a first spring so as to move a valve ball away from an entry lips in the entry chamber; moving the fluid through the entry lips into an expansion chamber; breaking the fluid into a fine mist, rising the fluid pressure in the expansion chamber to compress a second spring, thereby unseating a nozzle plunger from a nozzle lips of the device body; directing the fine mist from the nozzle lips, along a conical divergent surface to achieve a wide angle spray and thereby reduce the fluid pressure in the expansion chamber so as to seal the nozzle lips; whereby a small volume of the fine mist is emitted into the high pressure line.

4. The method of claim 2 further comprising the step of turning the fine mist by approximately 90 angular degrees prior to emitting the fine mist into the high pressure line.

* * * * *